US007949449B2

(12) United States Patent
Koch et al.

(10) Patent No.: US 7,949,449 B2
(45) Date of Patent: May 24, 2011

(54) CONSTANT WORK TOOL ANGLE CONTROL

(75) Inventors: Roger D. Koch, Pekin, IL (US); Hiren R. Patel, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 727 days.

(21) Appl. No.: 11/960,228

(22) Filed: Dec. 19, 2007

(65) Prior Publication Data

US 2009/0159302 A1 Jun. 25, 2009

(51) Int. Cl.
*E02F 5/02* (2006.01)

(52) U.S. Cl. ..... 701/50; 701/300; 37/414

(58) Field of Classification Search ..... None
See application file for complete search history.

(56) References Cited

U.S. PATENT DOCUMENTS

| | | | | |
|---|---|---|---|---|
| 3,899,028 | A | 8/1975 | Morris et al. | |
| 5,208,763 | A | 5/1993 | Hong et al. | |
| 5,308,219 | A | 5/1994 | Lee et al. | |
| 5,356,260 | A | 10/1994 | Ikari et al. | |
| 5,424,623 | A | 6/1995 | Allen et al. | |
| 5,598,648 | A | 2/1997 | Moriya et al. | |
| 5,768,810 | A | 6/1998 | Ahn | |
| 5,782,018 | A | 7/1998 | Tozawa et al. | |
| 5,903,988 | A | 5/1999 | Tochizawa et al. | |
| 6,047,228 | A * | 4/2000 | Stone et al. | 701/50 |
| 6,108,948 | A | 8/2000 | Tozawa et al. | |
| 6,233,511 | B1 * | 5/2001 | Berger et al. | 701/50 |
| 6,532,409 | B1 * | 3/2003 | Fujishima et al. | 701/50 |
| 6,609,315 | B1 | 8/2003 | Hendron et al. | |
| 6,655,465 | B2 * | 12/2003 | Carlson et al. | 172/4.5 |
| 6,763,619 | B2 | 7/2004 | Hendron et al. | |
| 6,968,241 | B2 | 11/2005 | Vonnoe et al. | |
| 7,093,383 | B2 | 8/2006 | Mennen et al. | |
| 7,140,830 | B2 | 11/2006 | Berger et al. | |
| 7,222,444 | B2 | 5/2007 | Hendron et al. | |
| 2005/0131610 | A1 | 6/2005 | Sahm et al. | |
| 2005/0132618 | A1 * | 6/2005 | Koch | 37/348 |
| 2006/0042804 | A1 * | 3/2006 | Pecchio | 172/4.5 |
| 2006/0173600 | A1 * | 8/2006 | Dietsch et al. | 701/50 |

* cited by examiner

*Primary Examiner* — Michael J. Zanelli
(74) *Attorney, Agent, or Firm* — Leydig, Voit & Mayer

(57) ABSTRACT

A method of controlling a work tool with respect to a design surface gradient identifies surface gradient and determines a desired angle for the work tool. Movement of the machine is monitored and the distance between the design surface gradient and the work tool is determined. The angle of the work tool is varied based on one or more of these parameters.

20 Claims, 4 Drawing Sheets

CONSTANT WORK TOOL ANGLE CONTROL

TECHNICAL FIELD

This patent disclosure relates generally to controlling work tools attached to a machine and, more particularly to controlling the angle of a work tool in response to the movement of the machine.

BACKGROUND

Work machines, for example, hydraulic excavators, often perform tasks using a work tool. For example, a hydraulic excavator may dig a trench in the earth using a work tool, such as a bucket. An operator typically controls the machine and work tool. In the case of an excavator, an operator controls the excavator's engine speed, forward movement, rotational movement, the movement of the boom and the pitch and angle of the bucket. Controlling all aspects of the excavator's movement requires a highly trained operator.

As an example operation, an excavator may be clearing a ditch. The operator orients the excavator to travel parallel to the ditch. The excavator may be positioned at any point along the ditch. The ground along the ditch may be uneven. For example, the ground at one point may slope towards the ditch and at another point the ground may slope away from the ditch. Thus, the excavator may be tipped along its roll axis. The operator guides the bucket along the ditch surface until the bucket fills with dirt. The operator then levels the bucket to maintain the captured load. As the operator raises the bucket out of the ditch, the boom is swung away from the ditch to dump the load. During the swing operation the bucket angle relative to the horizon changes by the amount the machine is tipped along its roll axis. Therefore, the operator must make constant adjustments to the level of the bucket to prevent spilling the load. Controlling all aspects of a work machine, such as an excavator, requires a highly skilled operator.

Even a highly skilled operator can not perform a ditch clearing operation as quickly when the excavator is tipped. After the operator fills and raises the bucket, the bucket is swung away from the ditch. However, the operator must constantly make adjustments to the angle of the bucket. In order to prevent the load from spilling, the operator often must slow the swing rate of the machine, so that the bucket angle adjustments can be made before any material spills from the bucket.

In addition to maintaining the work tool angle as the machine swings the bucket away from the ditch, the operator must vary the angle of the bucket during other steps in the machine's work cycle. For example, as the bucket approaches the dump point, the operator must vary the angle of the bucket such that the material in the bucket falls from the bucket and lands at the correct dump point. As the operator swings the machine back to the ditch, the angle of the bucket must be set at the correct angle to perform the next dig operation in the ditch. The correct dig angle may change based on the type and density of material being dug and the angle of the ditch with respect to both the surface of the earth and gravity.

Simple control schemes have been implemented to maintain a set work tool angle with respect to the earth. One exemplary system for maintaining a work tool angle is disclosed in U.S. Pat. No. 7,222,444 to Hendron et al. The disclosed system includes a tilt sensor attached to a bucket. The tilt sensor can sense bucket tilt angle relative to the earth and generate a corresponding bucket angle signal. A controller receives the bucket angle signal and generates a bucket control signal. Based on the bucket control signal, the machine moves the bucket to achieve the preselected angle with respect to the earth. While this system can maintain an approximately set angle for a work tool, it can not vary the angle of the work tool based on the task the machine is performing.

The foregoing background discussion is intended solely to aid the reader. It is not intended to limit the disclosure, and thus should not be taken to indicate that any particular element of a prior system is unsuitable for use within the disclosure, nor is it intended to indicate that any element is essential in implementing the innovations described herein. The implementations and application of the innovations described herein are defined by the appended claims.

BRIEF SUMMARY

The disclosure describes, in one aspect, a method of controlling a work tool with respect to a design surface gradient. First, the design surface gradient is identified either automatically or manually. Next, an angle for the work tool is determined either automatically or manually. Any movement of the machine is monitored and the distance between the design surface gradient and the work tool is determined. Finally, the angle of the work tool is varied based on the current angle of the work tool, the movement of the machine and the distance from the design surface gradient to the work tool.

The disclosure further describes a system for controlling the movement of a work tool connected to a machine. A work implement assembly connected to a work tool, varies the position of the work tool. At least one sensor associated with the work implement and connected to a processor determines the physical position of the work implement assembly and the physical position of the work tool. At least one input device generates a signal indicating a desired change to the position of the work implement assembly. The processor receives the signal from the at least one input device, calculates a physical position of the work implement assembly, determines the current physical position of the work implement assembly and the current physical position of the work tool and sets the work tool to an appropriate physical position.

BRIEF DESCRIPTION OF THE DRAWING(S)

DETAILED DESCRIPTION

This disclosure relates to a system and method for controlling a work tool connected to a machine. The described technique includes identifying a design surface gradient either automatically or manually, determining an angle for the work, monitoring the movement of the machine, determining a distance from the design surface gradient to the work tool and finally varying the angle of the work tool, such that the angle of the work tool is based on the current angle of the work tool, the movement of the machine and the distance from the design surface gradient to the work tool.

Figure 1:
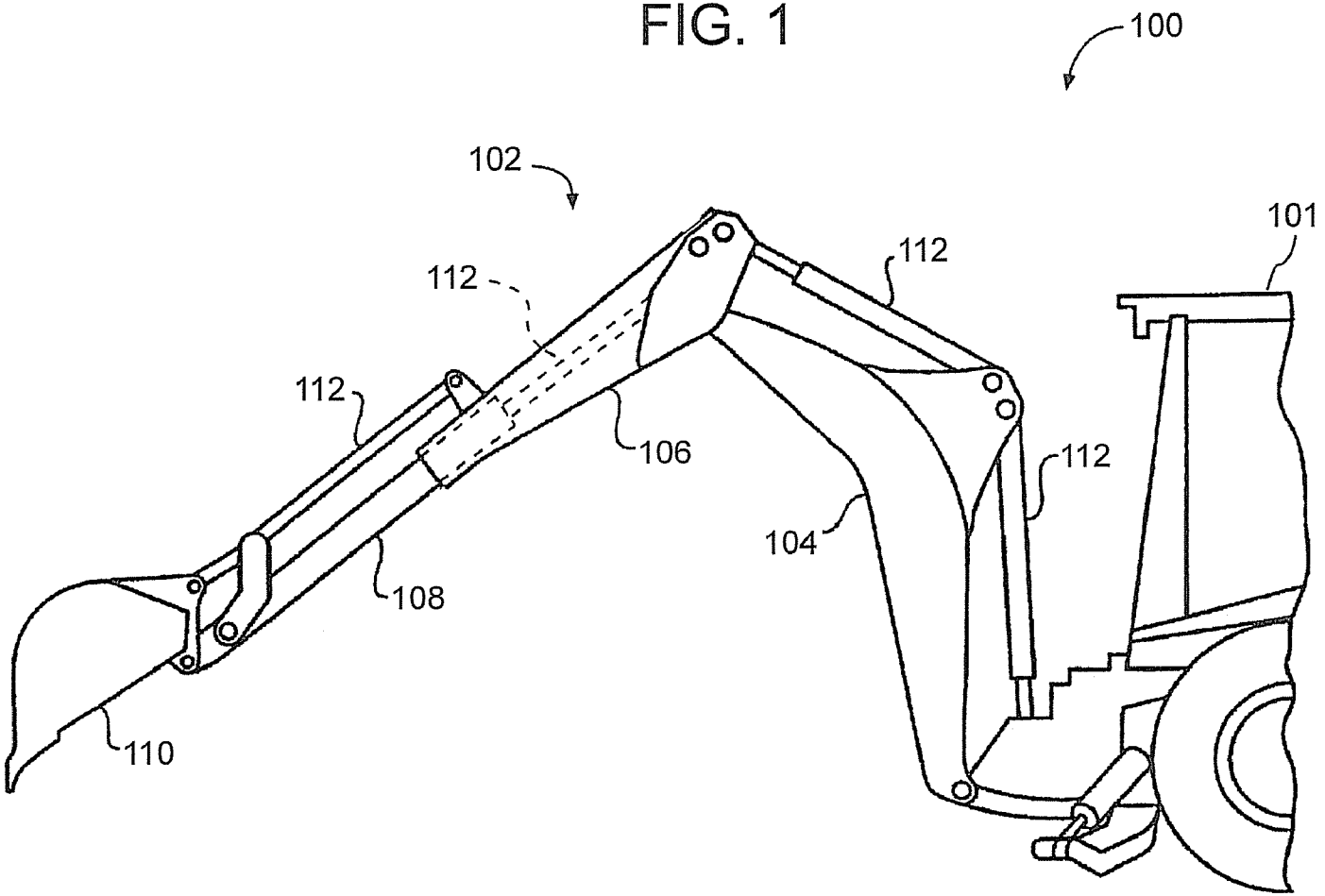
FIG. 1 illustrates a side view of a work machine.

Referring now to the drawings, FIG. 1 illustrates an exemplary embodiment of a relevant portion of a work machine 100. The work machine 100 may be used for a wide variety of earth-working and construction applications. Although the work machine 100 is shown as a backhoe loader, it is noted that other types of work machines 100, e.g., excavators, front shovels, material handlers, and the like, may be used with embodiments of the disclosed system.

The work machine 100 includes a body 101 and work implement assembly 102 having a number of components, including, for example, a boom 104, a stick 106, an extendable stick 108, and a work tool 110, all controllably attached to the work machine 100. The boom 104 is pivotally connected to the body 101, the stick 106 is pivotally attached to the boom 104, the extendable stick 108 is slidably associated with the stick 106, and the work tool 110 is pivotally attached to the extendable stick 108. In the illustrated embodiment, the work implement assembly 102 pivots relative to the body 101 in a substantially horizontal direction and in a substantially vertical direction.

Actuators 112 may be connected between each of the components of the work implement assembly 102. In the illustrated embodiment, each of the actuators 112 provide and cause movement between pivotally and/or slidably connected components. The actuators 112 may be, for example, hydraulic cylinders. The movement of the actuators 112 may be controlled in a number of ways, including controlling the rate and direction of fluid flow to the actuators 112.

Figure 2:
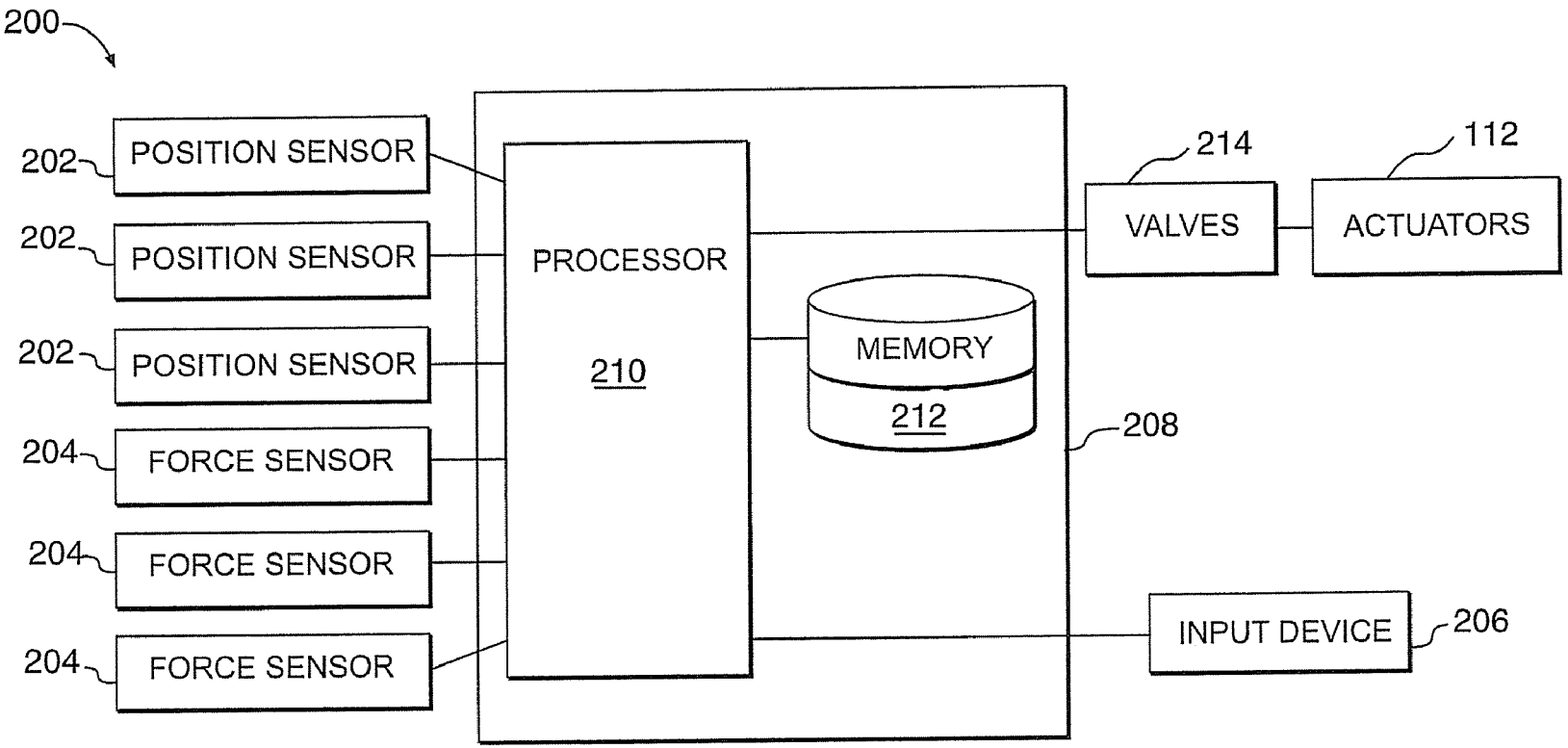
FIG. 2 is a block diagram illustrating an exemplary control apparatus for a controlling a work machine.

As shown in FIG. 2, hydraulic cylinder valves 214 may be disposed in fluid lines leading to the actuators 112. The valves 214 may be adapted to control the flow of fluid to and from the actuators. The position of the valves 214 may be adjusted to coordinate the flow of fluid to control the rate and direction of movement of the associated actuators 112 and the components of the work implement assembly 102.

FIG. 2 shows an exemplary control apparatus 200 adapted to control movement of the work implement assembly 102. The control apparatus 200 may include one or more position sensors 202, one or more force sensors 204, an input device 206, and a control module 208. The control apparatus 200 may include other components, as would be readily apparent to one skilled in the art.

In the exemplary embodiment, the position sensors 202 are configured to sense the movement of the components of the work implement assembly 102. For example, these position sensors 202 may be operatively coupled to the actuators 112. Alternatively, the position sensors 202 may be operatively coupled to the joints connecting the various components of the work implement assembly 102. These sensors may be, for example, length potentiometers, radio frequency resonance sensors, rotary potentiometers, angle position sensors or the like. The processor 210 receives data from the position sensors 202. After sensing the position, the position sensors 202, send the data to the processor 210. After obtaining the position data, the processor determines the position of the work implement assembly 102 by, for example, executing computer-executable instructions located on a medium, such as the memory 212.

In the exemplary embodiment, the force sensors 204 measure external loads applied to the work implement assembly 102 and develop force sensing signals representing the external loads. The force sensors 204 may be pressure sensors for measuring the approximate pressure of fluid within any of the actuators 112. The pressure of the fluid within the actuators 112 may be used to determine the magnitude of the applied loads. In this exemplary embodiment, the force sensors 204 comprise two pressure sensors associated with each actuator 112 with one pressure sensor located at each end of the actuator 112. In another exemplary embodiment, the force sensors 204 are a single strain gauge load cell in line with each actuator 112. The position sensors 202 and the force sensors 204 may communicate with a signal conditioner (not shown) for conventional signal excitation scaling and filtering. In one exemplary embodiment, each individual position sensor 202 and force sensor 204 may contain a signal conditioner within its sensor housing.

The control apparatus 200 may also include an input device 206, used to input information or operator instruction to control components of the work machine 100, such as the work implement assembly 102. The input device 206 may be used, for example, to generate control signals that represent requested motion of the work implement assembly 102. The input device 206 can be any standard input device, including, for example, a keyboard, a joystick, a keypad, a mouse, or the like.

In the illustrated embodiment, the position sensors 202, the force sensors 204, and the input device 206 electrically communicate with the control module 208. The control module 208 may be disposed on the work machine 100 or alternatively, may be remote from the work machine 100 and in communication with the work machine 100 through a remote link.

In an exemplary embodiment, the control module 208 contains a system controller or processor 210 and a memory 212. The processor may be a microprocessor or other processor, and may be configured to execute computer readable code or computer programming to perform functions. The memory 212 is in communication with the processor 210, and may provide storage of computer programs and executable code, including algorithms and data corresponding to known specifications of the work implement assembly 102.

In one exemplary embodiment, the memory 212 stores information relating to the desired movement of the work implement assembly 102 and work tool 110. The stored information may be predefined and loaded into the memory. For example, a digging boundary, including the location of a design surface gradient, for the work machine 100 may be created and loaded into the memory 212. Locating the design surface 300 gradient may be done manually or automatically. The digging boundary may represent the desired configuration of an excavation site, and may be a planar boundary, or an arbitrarily shaped surface. The predefined digging boundary may be, for example, obtained from blueprints and programmed into the control module 208, created through a graphical interface, or obtained from data generated by a computer aided drawing program (CAD/CAM) or similar program. Loading or entering the data into the control module, allows the system to monitor the digging boundary and design surface gradient. The system can thereby alert a user or prevent a user from digging outside the digging boundary. Preventing a user from digging outside the digging boundary helps alleviate digging mistakes. Additionally, the movement of the work implement assembly 102 and work tool 110 can be predetermined and loaded into the control module 208. The control module 208 may receive the design surface gradient from, by example, the memory 212. Alternatively, the digging boundary, movement of the work implement assembly and movement of the work tool 110 can be recording over time by, for example, a learning algorithm implemented in the control module 208. Mapping the digging boundary in this way does not require a user to predetermine the digging boundary.

In an exemplary embodiment, the control module 208 processes information obtained by the position sensors 202 and the force sensors 204 to determine the current position of and the current force applied against the work implement assembly 102 and work tool 110. The control module 208 may use standard kinematics or inverse kinematics analysis to calculate and determine the position of and force on the work tool 110. In an exemplary embodiment, based on the position of and the force applied to the work implement assembly 102, the control module 208 automatically causes the work tool to pivot to the correct position. In one embodiment, pitch and roll sensors located on the main frame of the machine are used in addition to linkage sensors to determine the attitude of the machine.

Figure 3A:
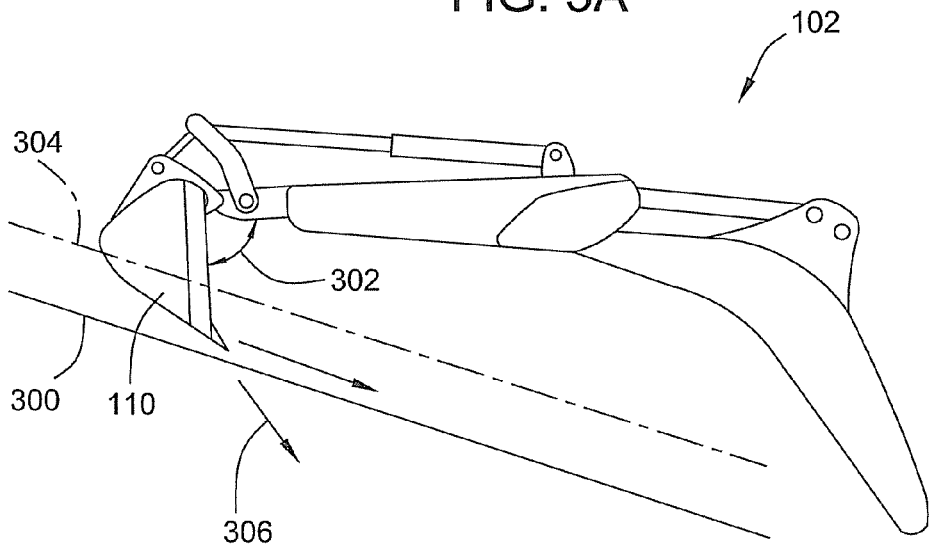
FIG. 3A illustrates the work machine of FIG. 1 modifying a design surface.

FIG. 3A illustrates the work machine of FIG. 1 modifying a design surface 300. In the illustrated embodiment, the work implement assembly 102 extends towards the design surface 300. In this embodiment, in order to dig, the work tool 110 must be set at the correct digging angle 302. The correct digging angle 302 varies based on the position of the work implement assembly relative to the design surface 300. As the work implement assembly 102 and work tool 110 approach the design surface 300, a threshold boundary 304 is crossed. The threshold boundary 304 defines a space above the design surface 300. Upon approaching the threshold boundary 304, the control module 208 sets the work tool 110 to the correct digging angle. The user requested motion vector 306 for the work tool 110 indicates the desired movement for the work tool 110. If the user requested motion vector 306 and position of the work tool 110 relative to the threshold boundary indicate that the user is preparing to modify the design surface, the control module 208 automatically places the work tool at the correct digging angle 302.

Figure 3B:
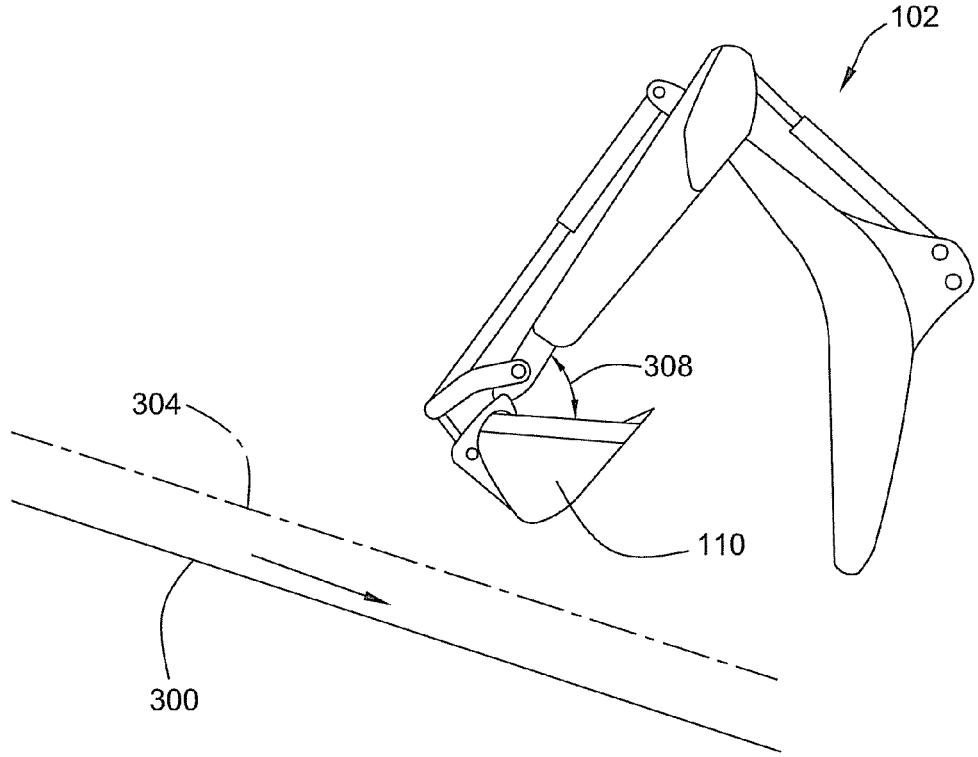
FIG. 3B illustrates the work machine of FIG. 1 transferring material from a design surface to second location.

FIG. 3B illustrates the work machine of FIG. 1 moving material from design surface 300. In this embodiment, as the work implement assembly 102 raises away from the design surface 300 and above the threshold boundary 304, the control module 208 automatically sets the work tool 110 at an appropriate load angle 308. The load angle 308 maintains the work tool 110 at an appropriate above-ground angle by adjusting the load angle as necessary, such that material in the work tool will not spill. Therefore the load angle 308 may vary as the work machine 100 moves over uneven terrain or the work implement assembly 102 moves. In one embodiment, the control module 208 maintains the load angle 308 with respect to gravity, such that the work tool 110 is level with respect to gravity.

In one embodiment, the control module 208 monitors the position sensors and force sensors, determines the action being performed by the work machine 100 and places the work tool 110 in the correct position for the activity being performed. In one embodiment, an operator of the machine may override the automatic control of the work tool 110 and manually control the work tool 110. However, in alternative embodiments, the control module 208 has control of the work tool 110.

Figure 4:
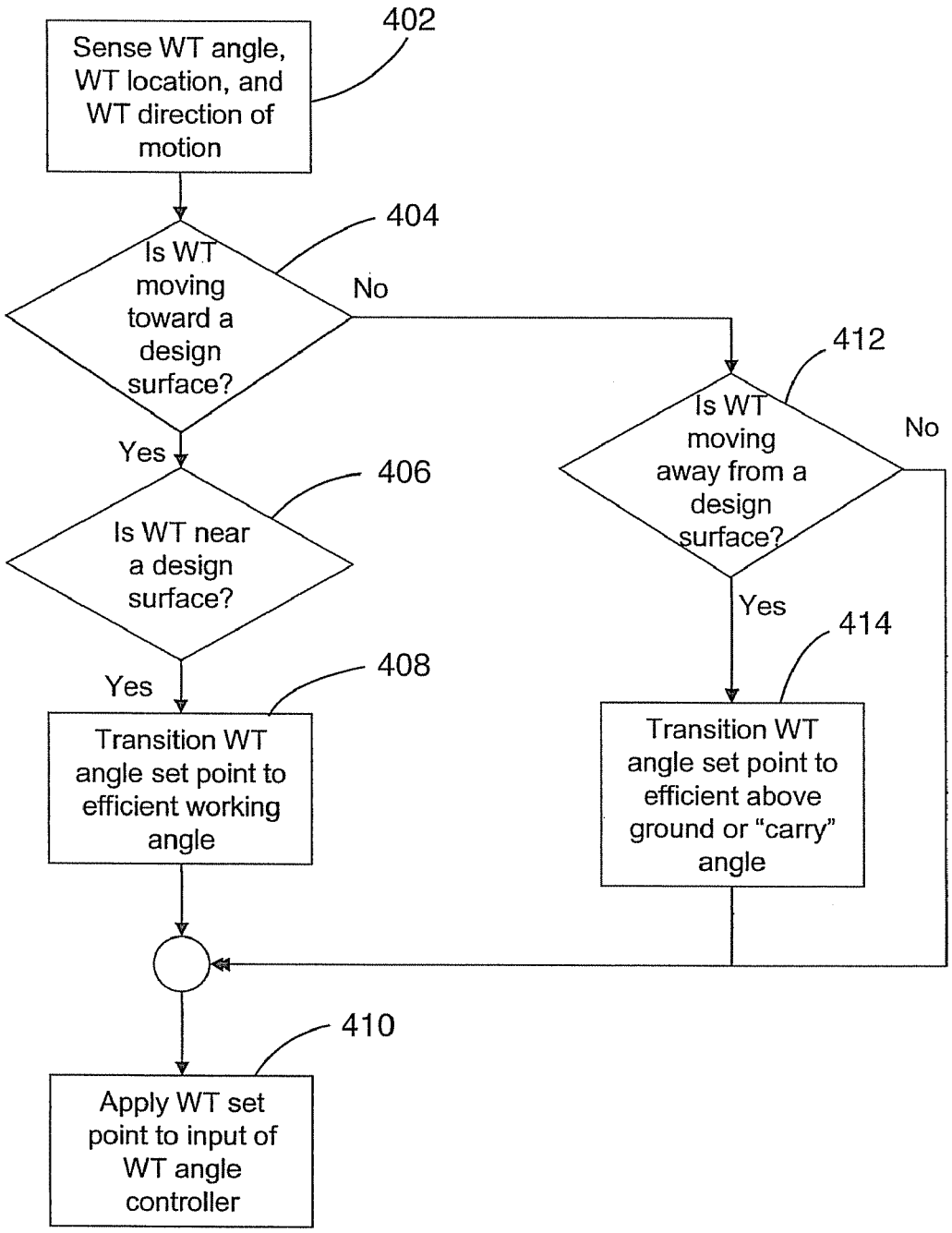
FIG. 4 is a flowchart illustrating a process for controlling a work tool connected to a work machine.

The flowchart in FIG. 4 illustrates a process for controlling the work tool 110 connected to the work machine 100 according to one embodiment of the disclosure. At step 402, the angle of the work tool 110, the work tool location in space and the work tool direction of motion are all determined. As noted above, the control module 208 may use standard kinematics or inverse kinematics analysis to determine the location of and force on the work tool 110. The machine may include sensors, such as accelerometers, mounted to the work tool 110. Sensors may also be mounted to the work implement assembly 102.

After determining the work tool 110 angle, location and direction, at step 404 the system determines whether the work tool is moving toward the design surface. The location of the design surface and the digging boundary may be created using a software tool, such as a CAD program. In an alternative embodiment, the operator of the work machine 100 uses the machine in a manual mode for a period of time. While the machine operates in manual mode, the control module 208 or another computing device monitors the movement of the work machine 100, work implement assembly 102 and work tool 110. By monitoring the repetitive movement of the work machine 100, work implement assembly 102 and work tool 110, the control module 208 can determine the location of the design surface 300. Additionally, the location of the threshold boundary 304 can be determined.

After determining at step 404 whether the work tool is moving toward the design surface, at step 406 the system determines whether the work tool 110 is near the design surface. As noted above, the location of the design surface can be determined in a number of ways including preprogramming the location into the control module 208 and having the control module 208 learn the location of the design surface by monitoring an operator's actions and the movement of the work machine 100, work implement assembly 102 and work tool 110. In one embodiment, the control module determines whether the work tool 110 crossed the threshold boundary 304. If the work tool 110 crosses the threshold boundary 304, then the system determines at step 406 that the work tool 110 is near the design surface.

If, during step 406, the system determines that the work tool 110 is approaching the design surface, then during step 408, the system transitions the work tool 110 to its efficient working angle. In one embodiment, illustrated in FIG. 3A, the efficient working angle corresponds to the correct digging angle 302. However, the efficient working angle may vary based on the work being accomplished and work environment. For example, the system may monitor soil density and moisture content among other factors when setting the efficient working angle for a particular work tool. Further, the efficient working angle may change over time as environmental conditions change. Finally, in some embodiments, an operator of the machine can set the efficient working angle manually. During step 410 the work tool 110 set point is applied to the input of the work tool angle controller. The work tool angle controller can be part of the control module and can be either a software component or a separate hardware component.

If at step 404 the system determines that the work tool 110 is not moving towards the design surface, then the system goes to step 412. At step 412, the system determines whether the work tool is moving away from the design surface. If the work tool 110 is moving away from the design surface, then at step 414 the system transitions the work tool 110 angle set point to an efficient above ground or carry angle. The efficient above ground angle can vary based on the work tool. In one embodiment, illustrated in FIG. 3B, the efficient above ground angle corresponds to the load angle 308 that allows the work tool 110 to carry material while minimizing any spillage. The efficient above ground angle may vary. For example, if the work implement assembly 102 rotates horizontally and the work machine 100 is positioned on sloping ground, the efficient above ground angle will vary with respect to the work implement assembly 102. In one embodiment, the above ground angle remains constant relative to gravity.

After transitioning the work tool 110 to the efficient above ground angle, the system applies the work tool set point to the input of the work tool angle controller at step 410. As noted above, the work tool angle controller can be a hardware component or a software component within the control module 208 or it can be a separate module.

INDUSTRIAL APPLICABILITY

The industrial applicability of the work tool angle control described herein will be readily appreciated from the foregoing discussion. The present disclosure is applicable to many machines and many tasks accomplished by machines. One exemplary machine suited to the disclosure is an excavator. Excavators are electro-hydraulic machines that often dig in soil. The exemplary method provided in FIG. 4 illustrates one method of implementing the process on an excavator tasked with digging. It should be reiterated that the foregoing discussion applies to many machines accomplishing a variety of tasks.

The disclosed work tool angle control allows the operator of a work machine to concentrate on tasks other than controlling the angle of the work tool. Depending on the task being accomplished, management of the work tool can take significant time and concentration by the operator. Thus, the operator may become fatigued if controlling the work tool in addition to all the other aspects of the machine. Fatigue may result in the operator completing less work in a given amount of time or may result in an accident. Therefore, the work tool angle control allows a machine to operate more efficiently.

Similarly, the methods and systems described above can be adapted to a large variety of machines and tasks. For example, backhoe loaders, compactors, feller bunchers, forest machines, industrial loaders, skid steer loaders, wheel loaders and many other machines can benefit from the methods and systems described.

It will be appreciated that the foregoing description provides examples of the disclosed system and technique. However, it is contemplated that other implementations of the disclosure may differ in detail from the foregoing examples. All references or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A method of controlling a work tool connected to a machine, the work tool having a working angle defined with respect to a design surface gradient, the method comprising the steps of:

locating the design surface gradient;

determining a position of the work tool relative to the design surface gradient;

monitoring movement of at least a component of the machine;

determining, with a control module, an efficient working angle for the work tool based on at least the located design surface gradient, data from force sensors and the position of the work tool;

determining a current work angle of the work tool; and adjusting, with a control module, the current work angle of the work tool to approximate the efficient working angle of the work tool based upon the movement of the component of the machine and the distance from the design surface gradient to the work tool.

2. The method of claim 1 further comprising loading data relating to the design surface gradient manually into a system controller.

3. The method of claim 2 further comprising entering the data relating to the design surface gradient into a computer aided drawing program.

4. The method of claim 1 further comprising the step of automatically mapping the design surface gradient.

5. The method of claim 4 wherein the step of automatically mapping the design surface gradient further comprises monitoring the movement of at least one component of the machine and the movement of the work tool during operator manual control.

6. The method of claim 1 further comprising determining an efficient above-ground angle for the work tool.

7. The method of claim 6 wherein the adjusting step further comprises setting the angle of the work tool to the efficient above-ground angle for the work tool.

8. The method of claim 1 wherein the step of monitoring movement of at least a component of the machine further comprises obtaining data from at least one position sensor operatively coupled to at least one actuator.

9. The method of claim 1 wherein the step of locating the design surface gradient further comprises identifying a digging boundary.

10. The method of claim 9 wherein the adjusting step further comprises preventing an operator from digging outside of the digging boundary.

11. A system for controlling the movement of a work tool connected to a machine comprising:

a work implement assembly connected to the work tool, the work implement assembly adapted to vary the position of the work tool in response to a position control signal;

a first sensor associated with the work implement assembly disposed to determine the position of the work implement assembly and to provide a first position sensing signal;

a second sensor associated with the work implement assembly disposed to determine a position of the work tool and to provide a second position sensing signal;

a third sensor associated with the work implement assembly disposed to determine a force on the work tool and to provide a force sensing signal;

at least one input device disposed to generate an input control signal indicating a desired change to the position of the work implement assembly;

a processor disposed to receive the input control signal, the first position sensing signal, the second position sensing signal, the force sensing signal, to calculate a desired position of the work implement assembly and to provide the position control signal to the work implement assembly to set the work tool to an appropriate efficient physical position.

12. The system of claim 11 further comprising:

a data set relating to a design surface gradient stored in a memory in communication with the processor; and the processor adapted to determine the direction of movement of the work tool with respect to the design surface gradient.

13. The system of claim 11 further including a second input device adapted to manually set the work tool to a second position.

14. The system of claim 11 further including a fourth sensor associated with the work tool and disposed to develop a force sensing signal, the processor adapted to receive the force sensing signal and to modify the physical position of the work tool.

15. The system of claim 11 further including at least one hydraulic actuator disposed to cause movement of the work implement assembly, and a hydraulic sensor disposed to monitor the at least one hydraulic actuator and to provide a hydraulic sensor signal relating to the position of the work implement assembly.

16. A computer readable medium having computer-executable instructions for controlling a work tool connected to a machine, the computer-executable instructions comprising:

instructions for locating a design surface gradient;

instructions for determining a position of the work tool relative to the design surface gradient;

instructions for monitoring movement of at least a component of the machine;

instructions for determining, with a control module, an efficient working angle for the work tool based on at least the located design surface gradient, data from force sensors and the position of the work tool;

instructions for determining a current work angle of the work tool; and instructions for adjusting, with a control module, the current work angle of the work tool to approximate the efficient working angle of the work tool based upon the movement of the component of the machine and the distance from the design surface gradient to the work tool.

17. The computer readable medium according to claim 16 further comprising instructions for determining an efficient above-ground angle for the work tool.

18. The computer readable medium according to claim 17 further comprising instructions for adjusting the angle of the work tool to the efficient above-ground angle for the work tool.

19. The computer readable medium according to claim 16 further comprising instructions for identifying a digging boundary.

20. The computer readable medium according to claim 19 further comprising instructions for preventing an operator from digging outside of the digging boundary.

* * * * *